US005769313A

United States Patent [19]

You

[11] Patent Number: 5,769,313

[45] Date of Patent: Jun. 23, 1998

[54] METHOD FOR CONTROLLING A HEATING OF A HEATER BASED ON A ROOM TEMPERATURE IN A HEATING-TYPE HUMIDIFIER

[75] Inventor: Sang-Uk You, Kyeongki-Do, Rep. of Korea

[73] Assignee: Daewoo Electronics Co., Ltd., Rep. of Korea

[21] Appl. No.: 808,359

[22] Filed: Feb. 28, 1997

[30] Foreign Application Priority Data

Feb. 28, 1996 [KR] Rep. of Korea ..... 96-5150

[51] Int. Cl.[6] ..... B60H 1/20; F24D 11/00

[52] U.S. Cl. ..... 236/44 C; 261/130; 261/DIG. 34

[58] Field of Search ..... 236/44 C; 126/113; 261/130, DIG. 34

[56] References Cited

U.S. PATENT DOCUMENTS 3,268,169 8/1966 De Bree ..... 261/130 X 5,364,024 11/1994 Lin ..... 236/44 C 5,529,060 6/1996 Salmon et al. ..... 128/203.16

*Primary Examiner*—William E. Wayner

*Attorney, Agent, or Firm*—Cushman Darby & Cushman Intellectual Property Group of Pillsbury Madison & Sutro, LLP

[57] ABSTRACT

A method for controlling a heating of a heater in a heating-type humidifier in which both a heating amount and a heating ON/OFF period is controlled on the basis of a present room temperature, is disclosed. A sensed present humidity is compared with an objective humidity which is set by a user. When the present humidity is greater than or equal to the objective humidity, whether or not water exists in a water tank of the humidifier is determined. When the water does not exist in the water tank, an alarm is generated. When the water exists, a humidifying operation stops. When the present humidity is less than the objective humidity, the humidifying operation is executed while increasing both a heating amount and a heating ON period of the heater in proportion to the present room temperature. As a result, the arrival times at the states of objective humidity are shortened.

17 Claims, 4 Drawing Sheets

METHOD FOR CONTROLLING A HEATING OF A HEATER BASED ON A ROOM TEMPERATURE IN A HEATING-TYPE HUMIDIFIER

BACKGROUND OF THE INVENTION

1. Field of the Invention

The present invention relates to a method for controlling a heating of a heater in a heating-type humidifier in which both a heating amount and a heating ON/OFF period is controlled on the basis of a present room temperature.

2. Description of the Prior Art

Recently, a variety of electronic products tends to have both the multifunction and many purposes in order to fulfill various needs of consumers. Accordingly, in humidifiers, various products which are designed to fulfill both the convenience and many purposes in behalf of users, i.e., those humidifiers which are used both as heating-type humidifiers and ultrasonic humidifiers or which consumes less electric power, have been developed and are widely used. In addition, the humidifiers which operate on the basis of ambient conditions related to air conditioning, i.e., a temperature and a humidity, have now been developed.

For example, U.S. Pat. No. 5,529,060 discloses humidifiers with control systems to prevent condensation in which the temperature of the humidified gases leaving the humidifying chamber of the humidifier is measured. The measured temperature is compared with a predetermined temperature required for a minimum humidity level for humidified gases supplied to a patient, and if the measured temperature is less than the predetermined temperature, a warning is provided. The humidifier also has a securing device for securing the humidifying chamber to the heater plate of the humidifier. The securing device comprises a sprung gate member which is biased in an upward position to prevent the humidifying chamber from being removed but may be pressed downwardly by a user in order to engage or remove the chamber.

However, in view of the various needs of consumers, in addition to the above-mentioned multifunctional humidifiers, humidifiers which have an enhanced humidification efficiency are required.

SUMMARY OF THE INVENTION

Therefore, it is a first object of the present invention to provide a method for controlling a heating of a heater in a heating-type humidifier in which both a heating amount and a heating ON/OFF period are controlled on the basis of a present room temperature.

It is a second object of the present invention to provide a method for controlling a heating of a heater in a heating-type humidifier in which the heating amount is increased in proportion to the present room temperature.

It is a third object of the present invention to provide a method for controlling a heating of a heater in a heating-type humidifier in which the heating ON period is increased in proportion to the present room temperature while the heating OFF period is decreased.

In order to achieve the above first, second and third objects, the present invention provides a method for controlling a heating of a heater based on a room temperature in a heating-type humidifier, which comprises the steps of:

(i) inputting parameters related to the performing of a humidifying operation;

(ii) comparing a present humidity inputted in step (i) with an objective humidity inputted in step (i);

(iii) determining whether or not water exists in a water tank of the humidifier and generating an alarm when it is determined in step (ii) that the present humidity is greater than or equal to the objective humidity;

(iv) stopping an operation of humidifying when it is determined in step (iii) that the water exists in the water tank; and (v) executing the humidifying operation while increasing a heating amount of the heater in proportion to the present room temperature inputted in step (i) when it is determined in step (ii) that the present humidity is less than the objective humidity.

Preferably, the parameters include a present room temperature, a present humidity and an objective humidity. Furthermore, after performing step (iv), a control means returns the procedure to step (iii) and performs the succeeding steps while an operating electric power is being supplied to the humidifier.

In the method for controlling a heating of a heater based on a room temperature in a heating-type humidifier according to the present invention, the humidifying operation is executed while increasing both a heating amount and a heating ON period of the heater in proportion to the present room temperature. As a result, the arrival times of the states of objective humidity are shortened.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

A description will be given below in detail with reference to accompanying drawings to the configuration and the operation of a method for controlling a heating of a heater based on a room temperature in a heating-type humidifier according to an embodiment of the present invention.

Figure 1:
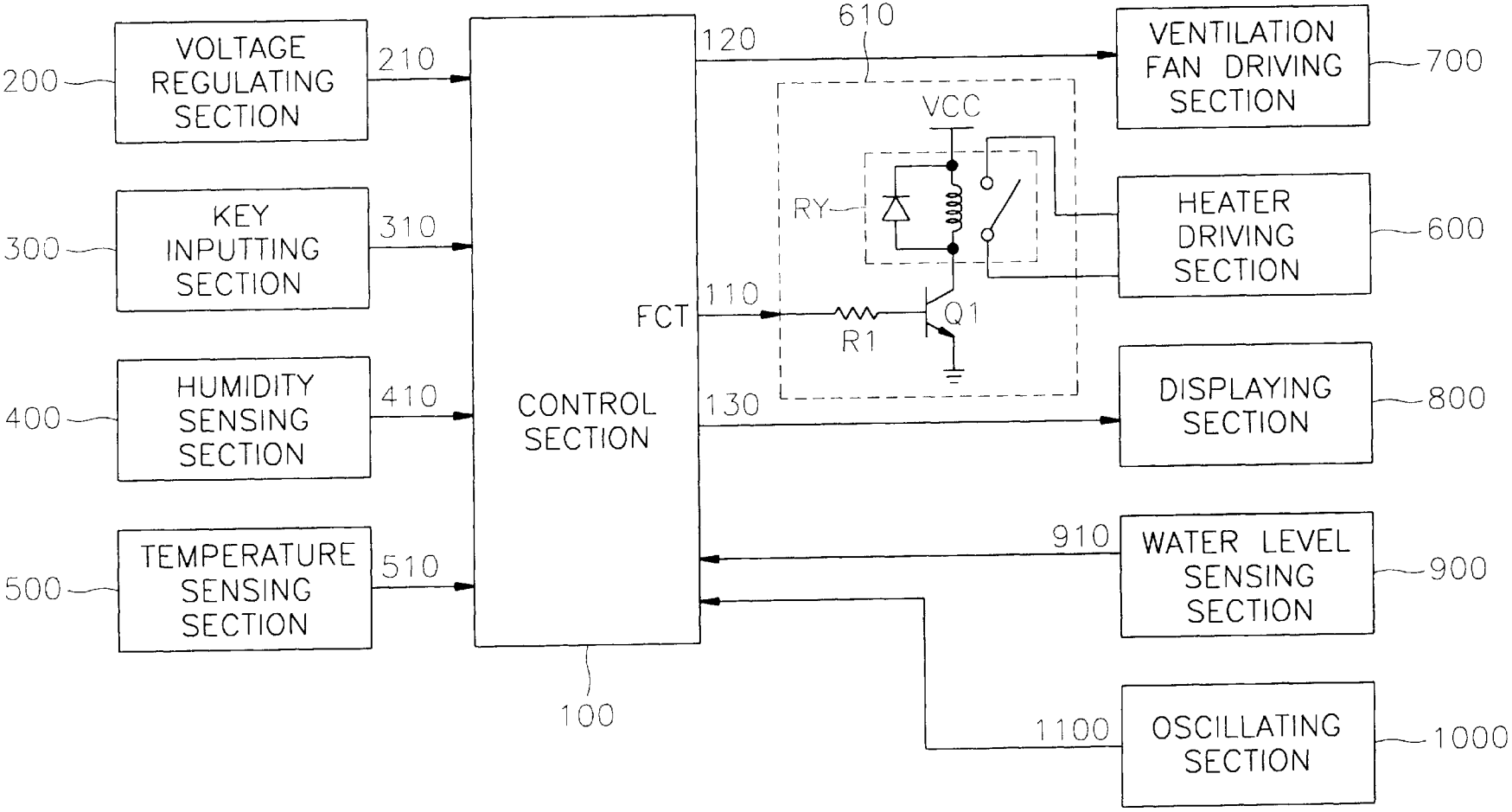
FIG. 1 is a circuit block diagram for showing the circuit configuration of a heating-type humidifier for performing a control method according to the present invention.

FIG. 1 is a circuit block diagram for showing the circuit configuration of a heating-type humidifier for performing a control method according to the present invention. As shown in FIG. 1, the heating-type humidifier comprises a control section 100, a voltage regulating section 200, a key inputting section 300, a humidity sensing section 400, a temperature sensing section 500, a heater driving section 600, a relay driving section 610, a ventilation fan driving section 700, a displaying section 800, a water level sensing section 900, and an oscillating section 1000.

Control section 100 controls the overall operation of the humidifier while inputting sensing signals which are supplied from both key inputting section 300 and a plurality of sensing sections.

Voltage regulating section 200 rectifies to regulate the voltage value of an alternating current power supply to a predetermined level and supplies a regulated voltage 210 of the alternating current power supply as an operating voltage to control section 100.

Key inputting section 300 has various keys by which a user inputs a variety of states such as a turn-on pre-setting of the humidifying operation, a time setting for the humidifying operation, an atomizing amount, an objective humidity and so forth, and supplies a key input signal 310 to control section 100.

Humidity sensing section 400 senses an ambient humidity and supplies a humidity sensing signal 410 to control section 100.

Temperature sensing section 500 senses an ambient temperature and supplies a temperature sensing signal 510 to control section 100.

Heater driving section 600 drives a heater (not shown) for humidifying operation in response to a first control signal 110 from control section 100, and thereby the heater heats to vaporize water which is contained in a water tank (not shown) of the humidifier.

Relay driving section 610 comprises a first transistor Q1, a first biasing resistor R1 and a relay RY. A base of first transistor Q1 is connected to the first control terminal FCT of control section 100 via first biasing resistor R1. A collector of first transistor Q1 is connected to relay RY. First transistor Q1 turns on while inputting first control signal 110 via first biasing resistor R1. Relay RY turns on when first transistor Q1 turns on. In contrast, when first transistor Q1 turns off, relay RY turns off. By a switching operation of relay RY, control section 100 makes a power supply of heater driving section 600 supply an electric power to the heater.

Ventilation fan driving section 700 drives a ventilation fan (not shown) in response to a second control signal 120 from control section 100, and thereby the ventilation fan outwardly atomizes water vapors which are generated by the heater.

Displaying section 800 displays various operating states of the humidifier in response to a third control signal 130 from control section 100.

Water level sensing section 900 senses a level of the water which is contained in the water tank, and supplies a water level sensing signal 910 to control section 100.

Oscillating section 1000 generates a clock pulse signal 1100 and supplies clock pulse signal 1100 as an operating clock signal to control section 100.

Figure 2A:
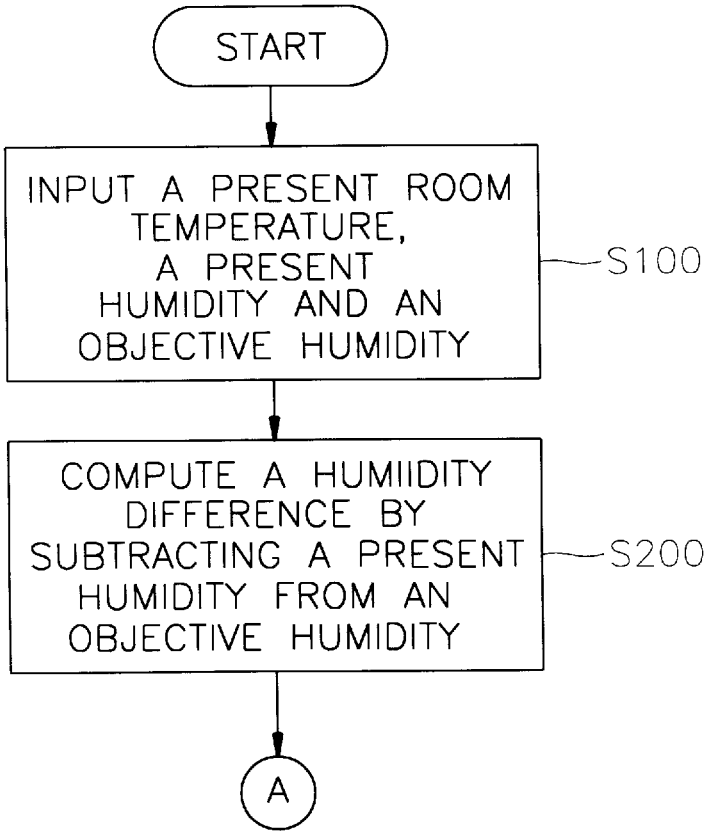
FIGS. 2A, 2B and 2C are a flowchart for illustrating a control method according to the present invention.
Figure 2B:
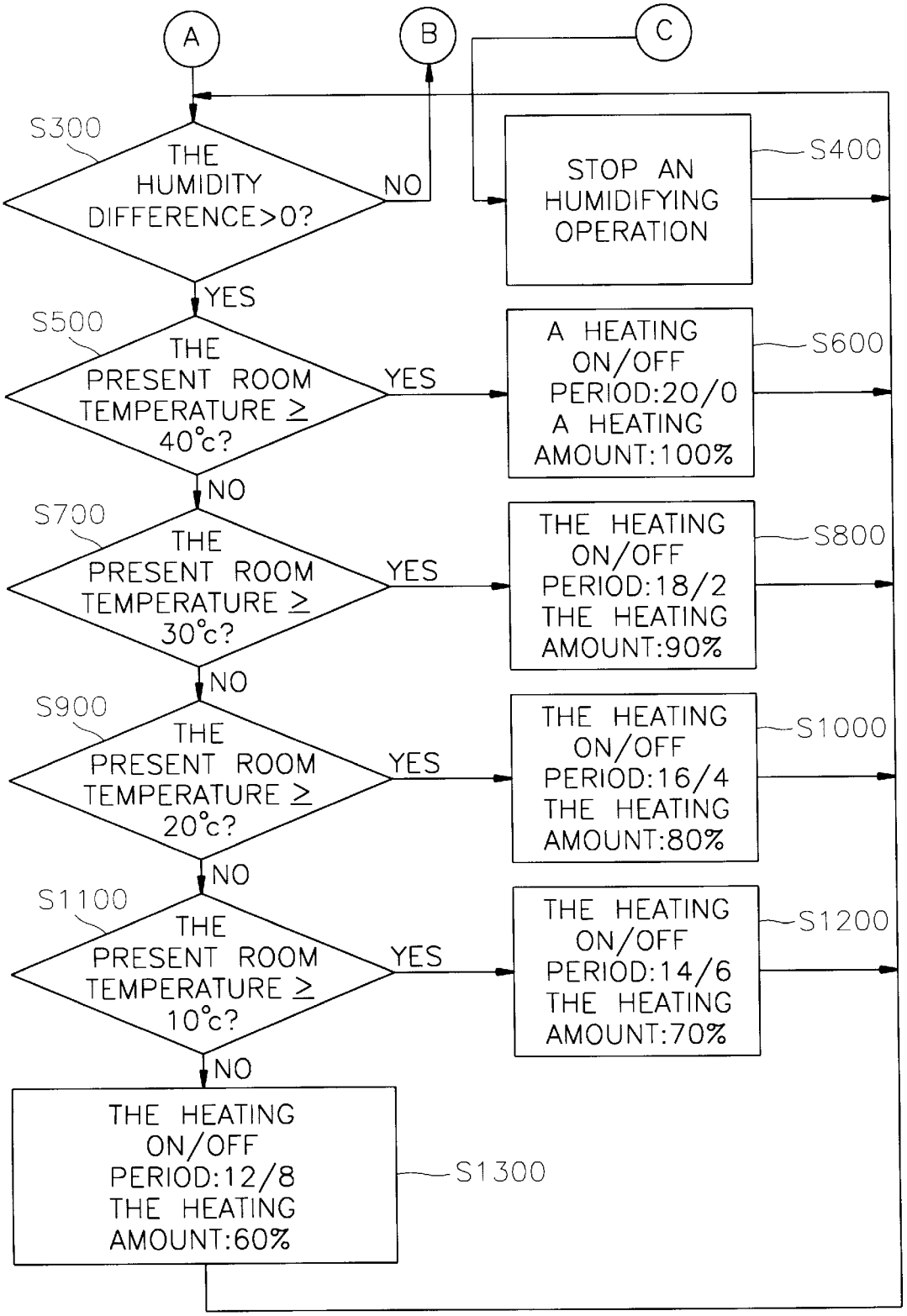
Figure 2C:
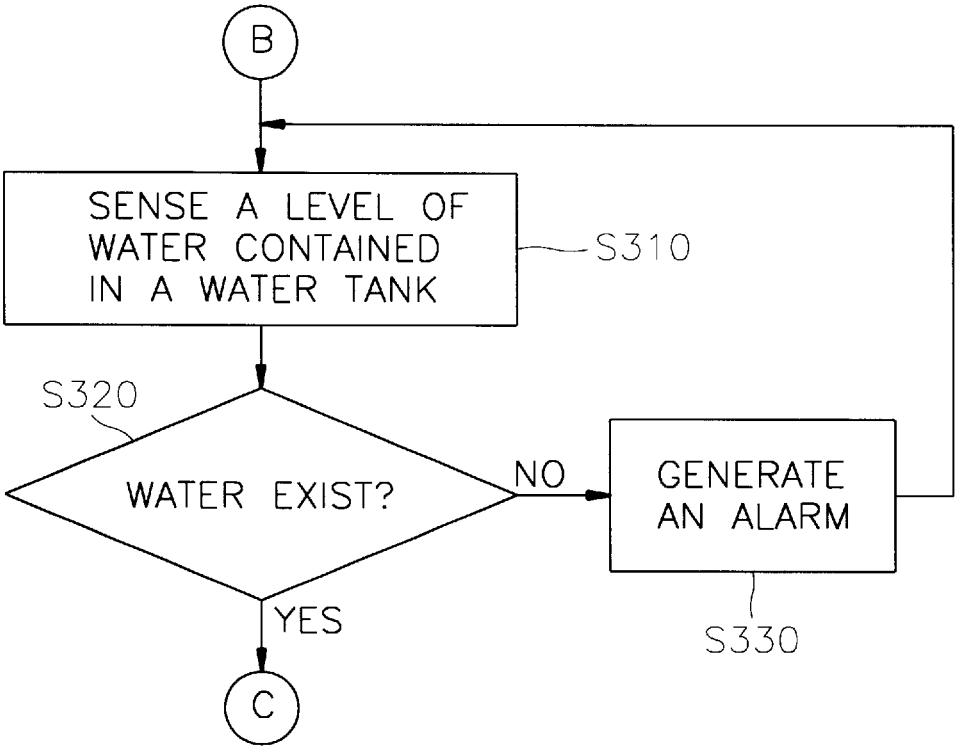

Referring to the flowchart of FIGS. 2A, 2B and 2C a description will be made next on the procedure for controlling a heating of a heater based on a room temperature in a heating-type humidifier which is performed by the apparatus shown in FIG. 1.

When a user turns a humidifying operation switch to an ON state and enters an objective humidity, an external a.c. power supply is supplied via voltage regulating section 200 to control section 100, and thereby regulated voltage 210 of the a.c. power supply from voltage regulating section 200 is supplied to control section 100. When control section 100 operates by regulated voltage 210 from voltage regulating section 200, control section 100 reads in temperature sensing signal 510 from temperature sensing section 500 and recognizes a present room temperature (step S100). Then, control section 100 recognizes a present ambient humidity by reading in humidity sensing signal 410 from humidity sensing section 400, and also inputs an objective humidity which is set by the user via key inputting section 300 (step S100). In step S200, control section 100 computes a humidity difference by subtracting the present humidity from the objective humidity. In step S300, control section 100 determines whether or not the humidity difference computed in step S200 is greater than zero.

When it is determined in step S300 that the present humidity is greater than or equal to the objective humidity, control section 100 makes water level sensing section 900 sense a level of the water which is contained in the water tank of the humidifier (step S310). In step S320, control section 100 determines whether or not water exists in the water tank. At this time, when it is determined in step S320 that the water does not exist, an alarm is generated in step S330. After performing step S330, control section 100 returns the procedure to step S310. In contrast, when it is determined in step S320 that the water exists, control section 100 renders both heater driving section 600 and ventilation fan driving section 700 inactive, and thereby stops the humidifying operation (step S400). After performing step S400, control section 100 returns the procedure to step S300.

When it is determined in step S300 that the present humidity is less than the objective humidity, control section 100 determines in step S500 whether or not the present room temperature is higher than or equal to 40° C.

When it is determined in step S500 that the present room temperature is higher than or equal to 40° C., in order to control the heating of the heater by setting a heating ON/OFF period to 20/0 and the heating amount to 100% in step S600, control section 100 applies to relay driving section 610 first control signal 110 which has a high or a low level voltage. When the high level of first control signal 110 is applied to first transistor Q1 via first biasing resistor R1 for 20 seconds, first transistor Q turns on and in turn, relay RY turns on. Then, by the switching operation of relay R, control section 100 makes the power supply of heater driving section 600 supply an electric power to the heater for 20 seconds at the heating amount of 100% in order to vaporize the water in the water tank. Because the room temperature is very high in this case, control section 100 controls the heater to have the heating amount of 100% in order to shorten an arrival time of a state of the objective humidity.

After performing step S600, control section 100 returns the procedure to step S300.

When it is determined in step S500 that the present room temperature is lower than 40° C., control section 100 determines in step S700 whether or not the present room temperature is higher than or equal to 30° C.

When it is determined in step S700 that the present room temperature is higher than or equal to 30° C., in order to control the heating of the heater by setting a heating ON/OFF period to 18/2 and the heating amount to 90% in step S800, control section 100 applies to relay driving section 610 first control signal 110 which has the high or the low level voltage. When the high level of first control signal 110 is applied to first transistor Q1 via first biasing resistor R1 for 18 seconds, first transistor Q1 turns on and in turn, relay RY turns on. Then, by the switching operation of relay RY, control section 100 makes the power supply of heater driving section 600 supply an electric power to the heater for 18 seconds at the heating amount of 90%.

Succeedingly, when it is determined in step S700 that the present room temperature is higher than or equal to 30° C., the low level of first control signal 110 is applied to first transistor Q1 via first biasing resistor R1 for 2 seconds. As a result, first transistor Q1 turns off and in turn relay RY turns off. Then, by the inactivation of relay RY for 2 seconds, control section 100 prevents the power supply of heater driving section 600 from supplying an electric power to the heater (step S800).

After performing step S800, control section 100 returns the procedure to step S300.

When it is determined in step S700 that the present room temperature is lower than 30° C., control section 100 determines in step S900 whether or not the present room temperature is higher than or equal to 20° C.

When it is determined in step S900 that the present room temperature is higher than or equal to 20° C., in order to control the heating of the heater by setting a heating ON/OFF period to 16/4 and the heating amount to 80% in step S1000, control section 100 applies to relay driving section 610 first control signal 110 which has the high or the low level voltage. When the high level of first control signal 110 is applied to first transistor Q1 via first biasing resistor R1 for 16 seconds, first transistor Q1 turns on and in turn, relay RY turns on. Then, by the switching operation of relay RY, control section 100 makes the power supply of heater driving section 600 supply an electric power to the heater for 16 seconds at the heating amount of 80%.

Succeedingly, when it is determined in step S900 that the present room temperature is higher than or equal to 20° C., the low level of first control signal 110 is applied to first transistor Q1 via first biasing resistor R1 for 4 seconds. As a result, first transistor Q1 turns off and in turn, relay RY turns off. Then, by the inactivation of relay RY for 4 seconds, control section 100 prevents the power supply of heater driving section 600 from supplying an electric power to the heater (step S1000).

After performing step S1000, control section 100 returns the procedure to step S300.

When it is determined in step S900 that the present room temperature is lower than 20° C., control section 100 determines in step S1100 whether or not the present room temperature is higher than or equal to 10° C.

When it is determined in step S1100 that the present room temperature is higher than or equal to 10° C., in order to control the heating of the heater by setting a heating ON/OFF period to 14/6 and the heating amount to 70% in step S1200, control section 100 applies to relay driving section 610 first control signal 110 which has the high or the low level voltage. When the high level of first control signal 110 is applied to first transistor Q1 via first biasing resistor R1 for 14 seconds, first transistor Q1 turns on and in turn, relay RY turns on. Then, by the switching operation of relay RY, control section 100 makes the power supply of heater driving section 600 supply an electric power to the heater for 14 seconds at the heating amount of 70%.

Succeedingly, when it is determined in step S1100 that the present room temperature is higher than or equal to 10° C., the low level of first control signal 110 is applied to first transistor Q1 via first biasing resistor R1 for 6 seconds. As a result, first transistor Q1 turns off and in turn, relay RY turns off. Then, by the inactivation of relay RY for 6 seconds, control section 100 prevents the power supply of heater driving section 600 from supplying an electric power to the heater (step S1200).

After performing step S1200, control section 100 returns the procedure to step S300.

When it is determined in step S1100 that the present room temperature is lower than 10° C., in order to control the heating of the heater by setting a heating ON/OFF period to 12/8 and the heating amount to 60% in step S1300, control section 100 applies to relay driving section 610 first control signal 110 which has the high or the low level voltage. When the high level of first control signal 110 is applied to first transistor Q1 via first biasing resistor R1 for 12 seconds, first transistor Q1 turns on and in turn, relay RY turns on. Then, by the switching operation of relay RY, control section 100 makes the power supply of heater driving section 600 supply an electric power to the heater for 12 seconds at the heating amount of 60%.

Succeedingly, when it is determined in step S1100 that the present room temperature is lower than 10° C., the low level of first control signal 110 is applied to first transistor Q1 via first biasing resistor R1 for 8 seconds. As a result, first transistor Q1 turns off and in turn, relay RY turns off. Then, by the inactivation of relay RY for 8 seconds, control section 100 prevents the power supply of heater driving section 600 from supplying an electric power to the heater (step S1300).

After performing step S1300, control section 100 returns the procedure to step S300.

In the method for controlling a heating of a heater based on a room temperature in a heating-type humidifier according to the present invention, the humidifying operation is executed while increasing both the heating amount and the heating ON period of the heater in proportion to the present room temperature. As a result, the arrival times at the states of objective humidity are shortened.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A method for controlling a heating of a heater based on a room temperature in a heating-type humidifier, said method comprising the steps of:

(i) inputting parameters related to the performing of a humidifying operation;

(ii) comparing a present humidity inputted in step (i) with an objective humidity inputted in step (i);

(iii) when it is determined in step (ii) that the present humidity is greater than or equal to the objective humidity, determining whether or not water exists in a water tank of the humidifier and generating an alarm when it is determined that water does not exist in the water tank;

(iv) stopping an operation of humidifying when it is determined in step (iii) that the water exists in the water tank; and (v) executing the humidifying operation while increasing a heating amount of the heater in proportion to the present room temperature inputted in step (i) when it is determined in step (ii) that the present humidity is less than the objective humidity.

2. The method for controlling a heating of a heater based on a room temperature in a heating-type humidifier as claimed in claim 1, wherein said parameters include a present room temperature, a present humidity and an objective humidity.

3. The method for controlling a heating of a heater based on a room temperature in a heating-type humidifier as claimed in claim 1, further comprising the substep of: returning to step (iii) after performing step (iv), and performing the succeeding steps while an operating electric power is being supplied to the humidifier.

4. The method for controlling a heating of a heater based on a room temperature in a heating-type humidifier as claimed in claim 1, wherein said step (iii) comprises the substeps of:

(a) sensing a level of the water contained in the water tank when it is determined in step (ii) that the present humidity is greater than or equal to the objective humidity;

(b) determining whether or not the water exists in the water tank;

(c) generating the alarm when it is determined in step (b) that the water does not exist in the water tank; and (d) returning to step (a) after performing step (c), and performing the succeeding steps while an operating electric power is being supplied to the humidifier.

5. The method for controlling a heating of a heater based on a room temperature in a heating-type humidifier as claimed in claim 1, wherein said step (v) comprises the substeps of:

(E) determining whether or not the present room temperature is higher than or equal to 40° C.;

(F) controlling the heating by setting a heating ON/OFF period to 20/0 and the heating amount to 100% when it is determined in step (E) that the present room temperature is higher than or equal to 40° C.;

(G) determining whether or not the present room temperature is higher than or equal to 30° C. when it is determined in step (E) that the present room temperature is lower than 40° C.;

(H) controlling the heating by setting the heating ON/OFF period to 18/2 and the heating amount to 90% when it is determined in step (G) that the present room temperature is higher than or equal to 30° C.;

(I) determining whether or not the present room temperature is higher than or equal to 20° C. when it is determined in step (G) that the present room temperature is lower than 30° C.;

(J) controlling the heating by setting the heating ON/OFF period to 16/4 and the heating amount to 80% when it is determined in step (I) that the present room temperature is higher than or equal to 20° C.;

(K) determining whether or not the present room temperature is higher than or equal to 10° C. when it is determined in step (I) that the present room temperature is lower than 20° C.;

(L) controlling the heating by setting the heating ON/OFF period to 14/6 and the heating amount to 70% when it is determined in step (K) that the present room temperature is higher than or equal to 10° C.; and (M) controlling the heating by setting the heating ON/OFF period to 12/8 and the heating amount to 60% when it is determined in step (K) that the present room temperature is lower than 10° C.

6. The method for controlling a heating of a heater based on a room temperature in a heating-type humidifier as claimed in claim 5, further comprising the substep of: returning to step (ii) after performing step (F), and performing the succeeding steps while the operating electric power is being supplied to the humidifier.

7. The method for controlling a heating of a heater based on a room temperature in a heating-type humidifier as claimed in claim 5, further comprising the substep of: returning to step (ii) after performing step (H), and performing the succeeding steps while the operating electric power is being supplied to the humidifier.

8. The method for controlling a heating of a heater based on a room temperature in a heating-type humidifier as claimed in claim 5, further comprising the substep of: returning to step (ii) after performing step (J), and performing the succeeding steps while the operating electric power is being supplied to the humidifier.

9. The method for controlling a heating of a heater based on a room temperature in a heating-type humidifier as claimed in claim 5, further comprising the substep of: returning to step (ii) after performing step (L), and performing the succeeding steps while the operating electric power is being supplied to the humidifier.

10. The method for controlling a heating of a heater based on a room temperature in a heating-type humidifier as claimed in claim 5, further comprising the substep of: returning to step (ii) after performing step (M), and performing the succeeding steps while the operating electric power is being supplied to the humidifier.

11. The method for controlling a heating of a heater based on a room temperature in a heating-type humidifier, said method comprising the steps of:

(A) inputting a present room temperature, a present humidity and an objective humidity;

(B) computing the humidity difference by subtracting the present humidity inputted in step (A) from the objective humidity inputted in step (A);

(C) determining whether or not the humidity difference computed in step (B) is greater than zero;

(D) sensing a level of the water contained in a water tank when it is determined in step (C) that the humidity difference is equal to or smaller than zero;

(E) determining whether or not the water exists in the water tank of the humidifier;

(F) generating an alarm when it is determined in step (E) that the water does not exist in the water tank;

(G) returning to step (D) after performing step (F), and performing the succeeding steps while an operating electric power is being supplied to the humidifier.

(H) stopping the humidifying operation when it is determined in step (E) that the the water exists in the water tank;

(I) determining whether or not the present room temperature is higher than or equal to 40° C. when it is determined in step (C) that the humidity difference is greater than zero;

(J) controlling the heating by setting a heating ON/OFF period to 20/0 and the heating amount to 100% when it is determined in step (I) that the present room temperature is higher than or equal to 40° C.;

(K) determining whether or not the present room temperature is higher than or equal to 30° C. when it is determined in step (I) that the present room temperature is lower than 40° C.;

(L) controlling the heating by setting the heating ON/OFF period to 18/2 and the heating amount to 90% when it is determined in step (K) that the present room temperature is higher than or equal to 30° C.;

(M) determining whether or not the present room temperature is higher than or equal to 20° C. when it is determined in step (K) that the present room temperature is lower than 30° C.;

(N) controlling the heating by setting the heating ON/OFF period to 16/4 and the heating amount to 80% when it is determined in step (M) that the present room temperature is higher than or equal to 20° C.;

(O) determining whether or not the present room temperature is higher than or equal to 10° C. when it is determined in step (M) that the present room temperature is lower than 20° C.;

(P) controlling the heating by setting the heating ON/OFF period to 14/6 and the heating amount to 70% when it is determined in step (O) that the present room temperature is higher than or equal to 10° C.; and (Q) controlling the heating by setting the heating ON/OFF period to 12/8 and the heating amount to 60% when it is determined in step (O) that the present room temperature is lower than 10° C.

12. The method for controlling a heating of a heater based on a room temperature in a heating-type humidifier as claimed in claim 11, further comprising the substep of: returning to step (C) after performing step (H), and performing the succeeding steps while the operating electric power is being supplied to the humidifier.

13. The method for controlling a heating of a heater based on a room temperature in a heating-type humidifier as claimed in claim 11, further comprising the substep of: returning to step (C) after performing step (J), and performing the succeeding steps while the operating electric power is being supplied to the humidifier.

14. The method for controlling a heating of a heater based on a room temperature in a heating-type humidifier as claimed in claim 11, further comprising the substep of: returning to step (C) after performing step (L), and performing the succeeding steps while the operating electric power is being supplied to the humidifier.

15. The method for controlling a heating of a heater based on a room temperature in a heating-type humidifier as claimed in claim 11, further comprising the substep of: returning to step (C) after performing step (N), and performing the succeeding steps while the operating electric power is being supplied to the humidifier.

16. The method for controlling a heating of a heater based on a room temperature in a heating-type humidifier as claimed in claim 11, further comprising the substep of: returning to step (C) after performing step (P), and performing the succeeding steps while the operating electric power is being supplied to the humidifier.

17. The method for controlling a heating of a heater based on a room temperature in a heating-type humidifier as claimed in claim 11, further comprising the substep of: returning to step (C) after performing step (Q), and performing the succeeding steps while the operating electric power is being supplied to the humidifier.

* * * * *